US007918152B2

(12) United States Patent
Tang

(10) Patent No.: US 7,918,152 B2
(45) Date of Patent: Apr. 5, 2011

(54) ELECTRIC CLING FILM CUTTER

(76) Inventor: Yi-Lin Tang, Tainan (TW)

( * ) Notice: Subject to any disclaimer, the term of this patent is extended or adjusted under 35 U.S.C. 154(b) by 380 days.

(21) Appl. No.: 12/124,160

(22) Filed: May 21, 2008

(65) Prior Publication Data

US 2009/0288535 A1 Nov. 26, 2009

(51) Int. Cl.
*B26D 1/06* (2006.01)
*B65H 35/06* (2006.01)

(52) U.S. Cl. ..... 83/614; 83/649; 242/554.2

(58) Field of Classification Search ..... 83/614, 83/648–650; 222/81, 83; 242/554.2, 564.3, 242/564.4
See application file for complete search history.

(56) References Cited

U.S. PATENT DOCUMENTS 3,365,992 A * 1/1968 Dreher ..... 83/614
3,808,928 A * 5/1974 Plegat ..... 83/289
4,286,487 A * 9/1981 Rubel ..... 83/58
4,856,397 A * 8/1989 Rebekale ..... 83/322
5,813,305 A * 9/1998 Miazga et al. ..... 83/508
6,079,305 A * 6/2000 Bloch et al. ..... 83/335
6,581,500 B1 * 6/2003 Kietaibl ..... 83/337
6,644,155 B2 * 11/2003 Phelps et al. ..... 83/339
7,370,564 B2 * 5/2008 Hennes ..... 83/353
2003/0116003 A1 * 6/2003 Kapiloff ..... 83/649

* cited by examiner

*Primary Examiner* — Edward Landrum
(74) *Attorney, Agent, or Firm* — Rosenberg, Klein & Lee

(57) ABSTRACT

An electric cling film cutter includes a base provided with a positioning frame, an auxiliary rotating rod and a driving device including a motor and a driving wheel unit. The base is assembled with a delivery wheel having its surface disposed with elongate flutes and plural guide grooves and one side provided with a driven rotating wheel engaged with the driving wheel unit. A cutter positioned before the delivery wheel contains a frame plate, a motor, a belt and a cutter base. The frame plate is provided with idle wheels parallel to and leaning on the delivery wheel. A stripping guide plate is positioned under the delivery wheel, having its upper end formed with plural protruding parting members respectively aligned to the guide grooves on the delivery wheel for pushing the cling film delivered to separate from the surface of the delivery wheel, convenient and safe in use.

1 Claim, 5 Drawing Sheets

ELECTRIC CLING FILM CUTTER

BACKGROUND OF THE INVENTION

1. Field of the Invention

This invention relates to an electric cling film cutter, particularly to one able to deliver and cut off cling film automatically and keep the cling film tidy and smooth, facilitating a user to fetch the cling film and safe in use.

2. Description of the Prior Art

A conventional cling film, as shown in FIG. 1, includes a roll of cling film 10 placed in a long casing 11 having its topside provided with an open-able outer cover 12, with a lengthwise opening formed between the outer cover 12 and the casing 11 and having its edge disposed with a serrated cutting member 13. In operating and using, firstly, draw the cling film 10 out of the casing 11 for a preset length to be used. Next, press the outer cover 12 with one hand, and hold the end of the cling film 10 with the other hand and apply a force to draw the cling film 10 reversely to let the cling film 10 cut off by the cutting member 13. However, to cut and tear off the conventional cling film 10, a user can press only one end of the outer cover 12 with one hand but cannot move the same hand along the casing 11 to press other parts of the outer cover 2 at the same time for evenly pressing the outer cover 2; therefore, the cling film 10 can hardly be cut and torn off with smoothness and with a balanced length, likely to make the cling film 10 tangled and deformed and hence resulting in inconvenience in operating and using.

In addition, the conventional cling film 10 has the serrated cutting member 13 disposed outside the casing 11; therefore, when drawing and tearing off the cling film 10, a user is likely to be cut by the sharp teeth of the cutting member 13 in case of operating carelessly.

SUMMARY OF THE INVENTION

The objective of this invention is to offer an electric cling film cutter able to automatically deliver out a cling film to a preset length to be used and electrically cut it off, able to keep the cling film tidy and smooth after it is cut off and safe in use.

The feature of this invention is a delivery wheel assembled in the interior of a base and having its surface fully disposed with lengthwise elongate flutes and plural guide grooves and having one side mounted with a driven rotating wheel engaged with the driving wheel unit of a driving device. A cutter is positioned in front of the delivery wheel, composed of a frame plate, a motor, a belt and a cutter base. The frame plate is installed thereon with at least one idle wheel parallel to and leaning on the delivery wheel. A stripping guide plate is set beneath the delivery wheel and has its upper end formed with plural protruding parting members respectively aligned to the guide grooves on the delivery wheel for pushing the cling film delivered out to separate from the surface of the delivery wheel 3 and no longer adhere thereon, convenient and safe in use.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
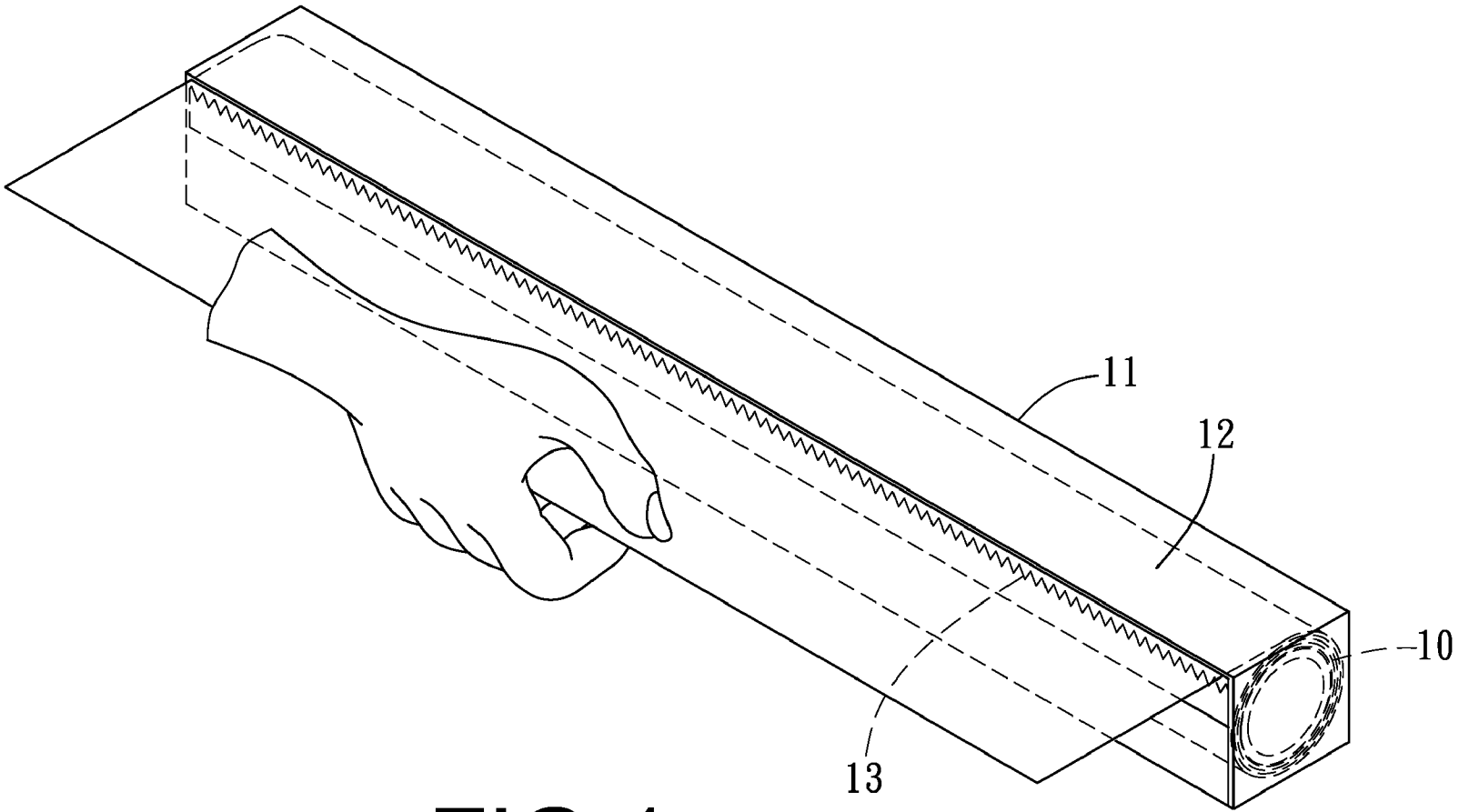
FIG.1 (PRIOR ART)
FIG. 1 is a perspective view of a conventional cling film cutter.
Figure 2:
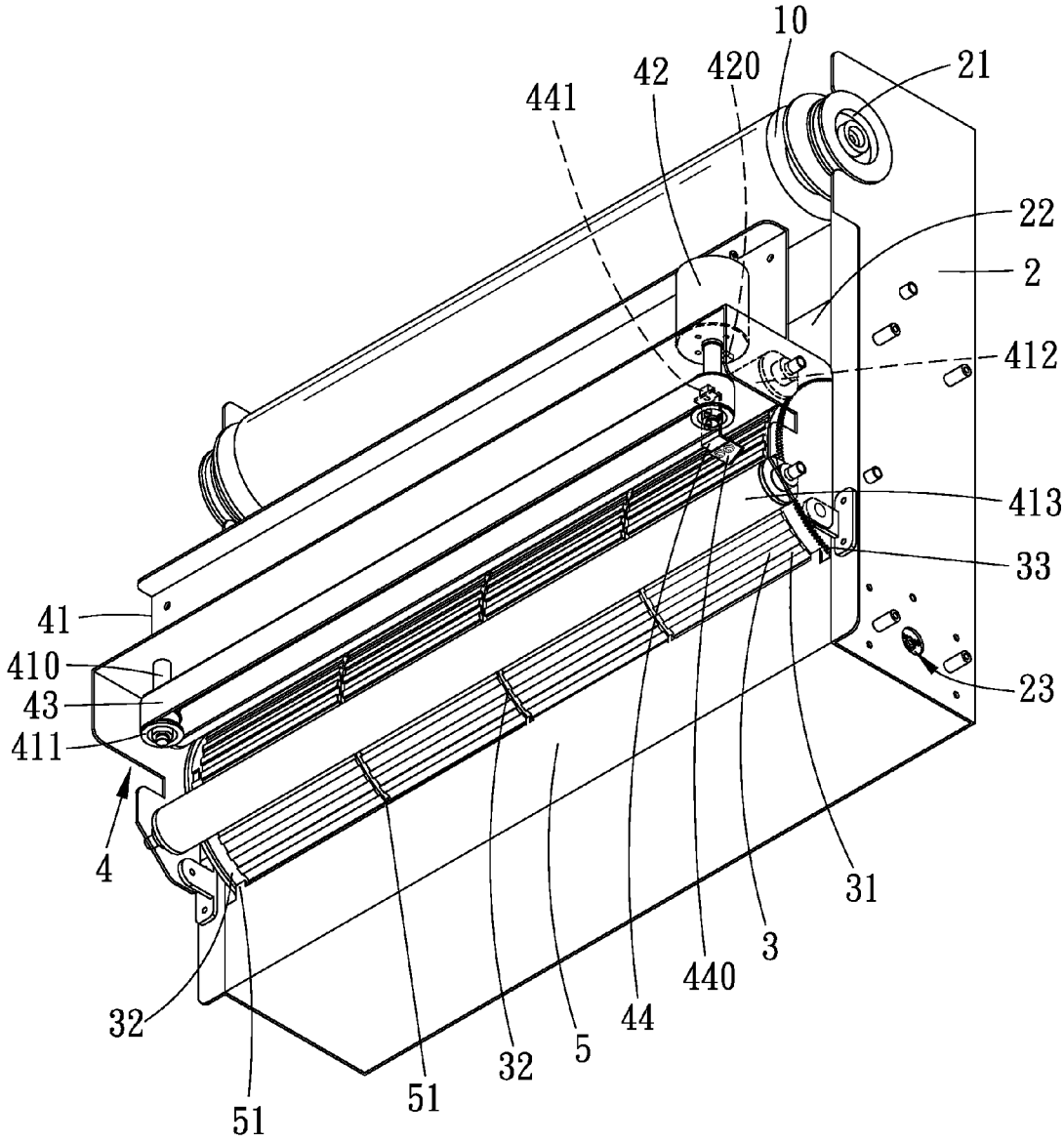
FIG. 2 is a perspective view of an electric cling film cutter in the present invention.
Figure 3:
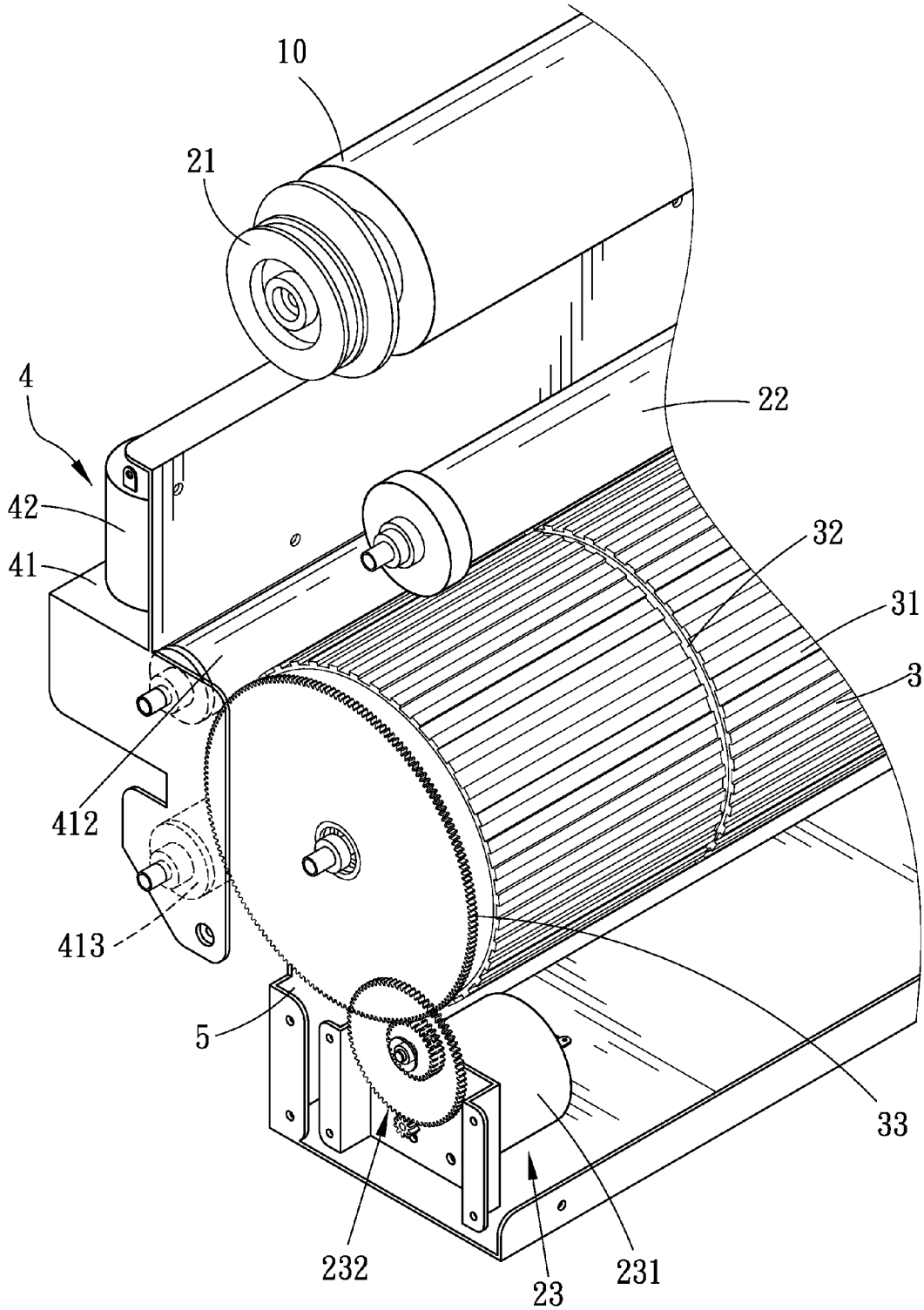
FIG. 3 is a partial perspective view of a driving device in the present invention.
Figure 4:
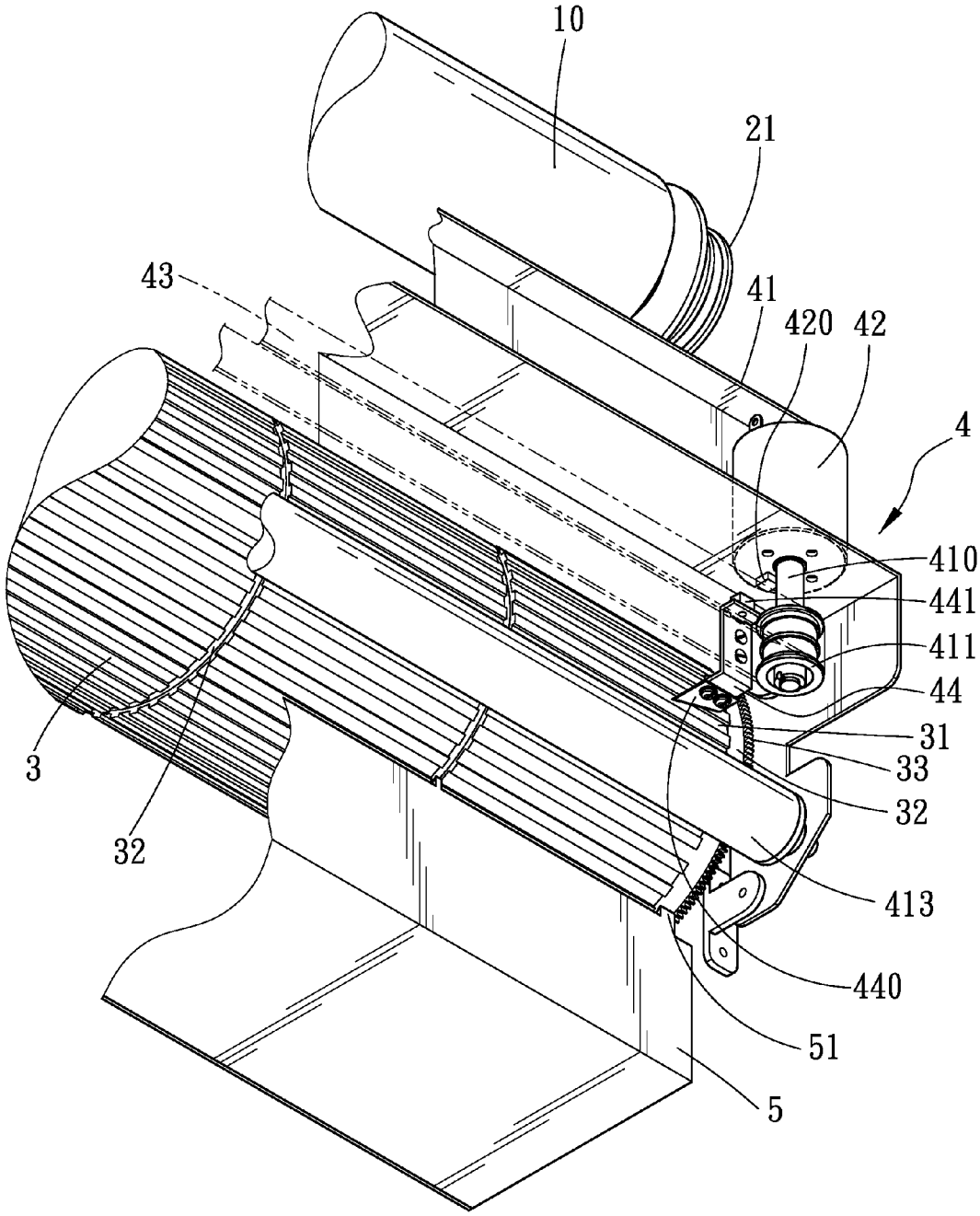
FIG. 4 is a perspective view of the electric cling film cutter viewed at another angle in the present invention.
Figure 5:
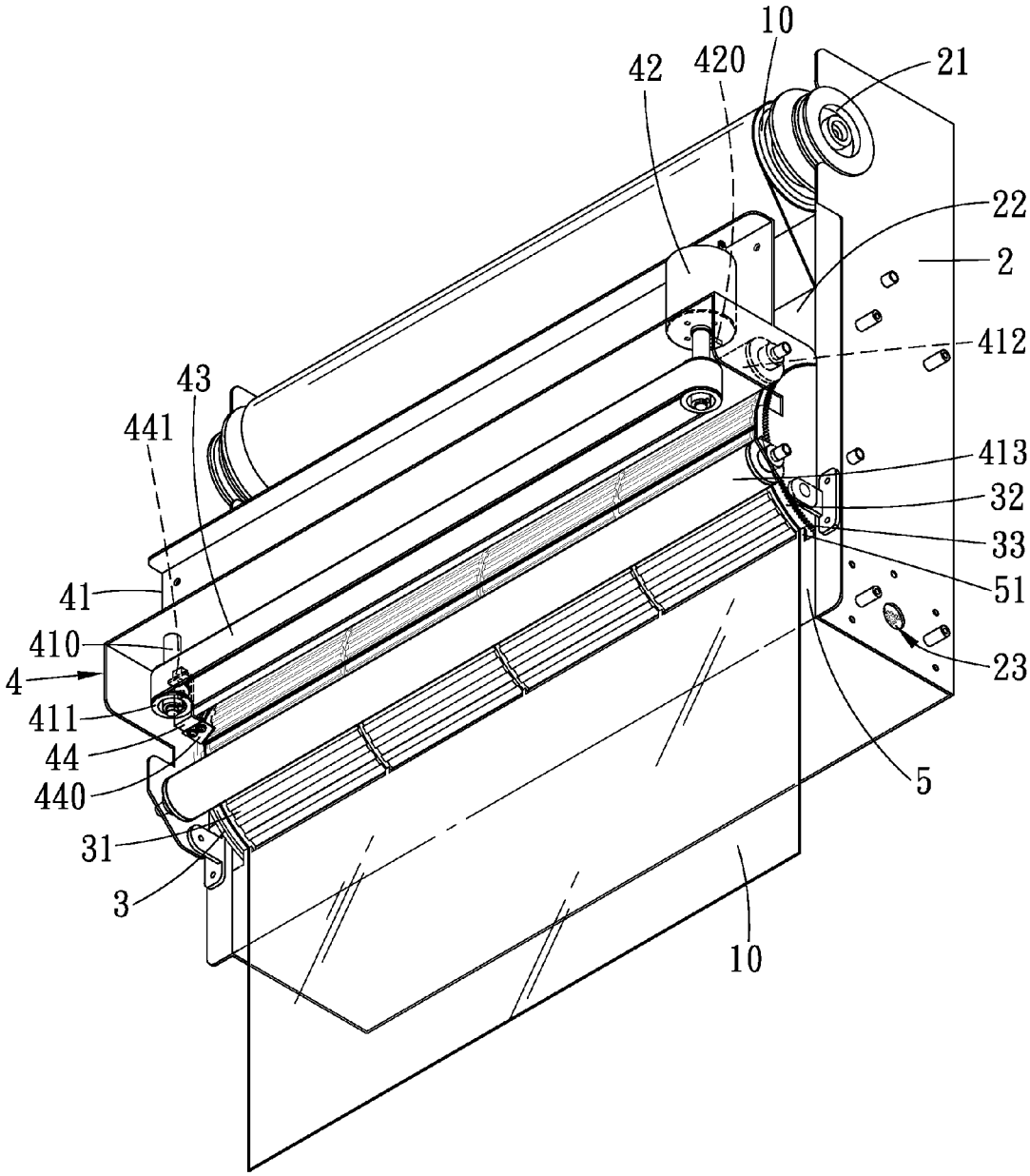
FIG. 5 is a perspective view of the electric cling film cutter in a using condition in the present invention.

A preferred embodiment of an electric cling film cutter in the present invention, as shown in FIGS. 2 and 3, includes a base 2, a delivery wheel 3, a cutter 4, and a stripping guide plate 5 as main components combined together.

The base 2 is provided thereon with a positioning frame 21 for fixing a cling film in position, and an auxiliary rotating rod 22 is disposed under the positioning frame 21 to assist guiding and delivering the cling film 10. A driving device 23 is installed in the interior of the base 2 near its lower side, consisting of a motor 231 and a deceleration driving wheel unit 232.

The delivery wheel 3 positioned in the base 2 has its surface fully disposed with transverse elongate flutes 31 and several longitudinal guide grooves 32 and one side assembled with a driven rotating wheel 33 engaged with the driving wheel unit 232 of the driving device 23 in the base 2.

The cutter 4 positioned in front of the delivery wheel 3 is composed of a frame plate 41, a motor 42, a belt 43 and a cutter base 44. The frame plate 41 is assembled on the base 2 and has its opposite sides respectively fixed with a shaft rod 410 extending downward and having its lower side fixed with a belt shaft seat 411. Further, the frame plate 41 is mounted thereon with an upper idle wheel 412 and a lower idle wheel 413 parallel to and leaning on the front side of the delivery wheel 3 to assist guiding and delivering the cling film 10. The motor 42 is installed on the frame plate 41 for correspondingly driving one shaft rod 410 and one belt shaft seat 411 and has its underside provided with an inductor 420. The belt 43 is fitted around the opposite belt shaft seats 411 at the lower side of the frame plate 41. The cutter base 44 secured on the belt 43 has its lower side fixed with a blade 440 having its cutting edge exactly aligned to the elongate flutes 31 in the surface of the delivery wheel 3. The cutter base 44 further has its upper side disposed with a magnetic member 441 to be aligned to the inductor 420 at the underside of the motor 42.

The stripping guide plate 5 is positioned under the delivery wheel 3 and has its upper end formed with plural protruding parting members 51 respectively aligned to the longitudinal guide grooves 32 of the delivery wheel 3 for pushing the cling film delivered out to part from the surface of the delivery wheel 3 and no longer adhere thereon, thus facilitating a user to fetch and use the cling film.

In using, referring to FIGS. 2 to 5, firstly, load the cling film 10 in the positioning frame 21 of the base 2 and draw it out to pass over the auxiliary rotating rod 22 and have its end adhering to the surface of the delivery wheel 3 and then start a power source and wait. In operating, a starting button is pressed to start the motor 231 of the driving device 23 to drive the driving wheel unit 232 to rotate and actuate the delivery wheel 3 to operate. Simultaneously the delivery wheel 3 will automatically and continuously draw out the cling film 10 on its surface. At this time, the upper and the lower idle wheel 412 and 413 parallel to and leaning on the front side of the delivery wheel 3 will help to roll and press the cling film 10 to make it tidy and smooth, and the cling film 10 delivered out will be pushed to part from the surface of the delivery wheel 3 by the parting members 51 of the stripping guide plate 5. After the cling film 10 is drawn out to a preset length needed by a user, release the starting button to temporarily stop the motor 231 from driving the delivery wheel 3 to operate, and then start the motor 42 of the cutter 4 to drive the shaft rod 410 and the belt 43 to rotate. Synchronously, the cutter base 44 fixed on the belt 43 will be transversely and linearly moved together with the belt 43 from one end and have the blade 440 cutting off the cling film 10 on the delivery wheel 3. When the cutter base 44 is rotated together with the belt 43 for one round, the inductor 420 at the underside of the motor 42 will induce the magnetic member 441 at the topside of the cutter base 44 and command the motor 42 to stop operating temporarily for stopping the belt 43 and the cutter base 44 from rotating. Thus, through electric cutting, the cling film 10 delivered out can be kept tidy and smooth, letting a user fetch and use the cling film 10 conveniently.

To sum up, the electric cling film cutter of this invention can automatically deliver and cut off the cling film and keep the cling film tidy and smooth, able to let a user to fetch and use the cling film conveniently and safe in use.

While the preferred embodiment of the invention has been described above, it will be recognized and understood that various modifications may be made therein and the appended claims are intended to cover all such modifications that may fall within the spirit and scope of the invention.

What is claimed is:

1. An electric cling film cutter comprising:

a base with a positioning frame provided thereon for fixing a cling film, an auxiliary rotating rod disposed under the positioning frame to assist guiding and delivering said cling film, said base having a driving device installed inside said base, said driving device composed of a motor and a driving wheel unit;

a delivery wheel assembled inside said base, said delivery wheel having its surface fully disposed with elongate flutes and plural guide grooves, said delivery wheel having one side provided with a driven rotating wheel engaged with said driving wheel unit of said driving device;

a cutter positioned in front of said delivery wheel, said cutter composed of a frame plate, a motor, a belt and a cutter base, said frame plate having at least one idle wheel assembled thereon, said at least one idle wheel parallel to and leaning on said delivery wheel, said frame plate of said cutter being assembled on said base having its opposite sides each respectively provided with a shaft rod and a belt shaft seat, said motor of said cutter being installed on said frame plate for correspondingly driving one of said shaft rods and one of said belt shaft seats and having its underside provided with an inductor, said belt being fitted around said belt shaft seats, said cutter base being threadably fixed on said belt and disposed with a blade, said blade having a cutting edge exactly aligned with said elongate flutes on the surface of the delivery wheel, said cutter base having an upper side disposed with a magnetic member to be aligned with said inductor at the underside of said motor of said cutter; and a stripping guide plate assembled under said delivery wheel, said stripping guide plate having its upper end formed with plural protruding parting members, said protruding parting members respectively aligned with said guide grooves on said delivery wheel for pushing said cling film delivered out to separate from the surface of said delivery wheel to facilitate a user to fetch and use said cling film.

* * * * *